US011653132B2

(12) United States Patent
Aiso

(10) Patent No.: US 11,653,132 B2
(45) Date of Patent: May 16, 2023

(54) AUDIO SIGNAL PROCESSING METHOD AND AUDIO SIGNAL PROCESSING APPARATUS

(71) Applicant: YAMAHA CORPORATION, Hamamatsu (JP)

(72) Inventor: Masaru Aiso, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/007,344

(22) Filed: Aug. 31, 2020

(65) Prior Publication Data

US 2021/0067855 A1 Mar. 4, 2021

(30) Foreign Application Priority Data

Sep. 3, 2019 (JP) ..... JP2019-160071

(51) Int. Cl.
*H04R 1/10* (2006.01)

(52) U.S. Cl.
CPC ..... *H04R 1/10* (2013.01)

(58) Field of Classification Search
CPC . H04R 5/033; H04R 5/04; H04R 1/10; H04R 1/1041; H04R 1/1016; H04R 2420/07; H04R 3/04; H03G 5/165; H03G 5/025; H03G 5/005; H04S 7/301; H04S 7/307; H04H 60/04; G11B 27/34; G11B 27/028; G11B 27/034; G11B 27/038
USPC ..... 381/74, 119, 98, 103
See application file for complete search history.

(56) References Cited

U.S. PATENT DOCUMENTS

2011/0026738 A1* 2/2011 Aoki ..... H04H 60/04 381/119
2012/0275616 A1* 11/2012 Yamamoto ..... H04R 29/001 381/74
2015/0104036 A1 4/2015 Mori
2016/0366518 A1* 12/2016 Strogis ..... H04S 7/306

FOREIGN PATENT DOCUMENTS

JP 2015080068 A 4/2015

* cited by examiner

*Primary Examiner* — Ahmad F. Matar
*Assistant Examiner* — Sabrina Diaz
(74) *Attorney, Agent, or Firm* — Rossi, Kimms & McDowell LLP

(57) ABSTRACT

An audio signal processing method performs signal processing on a first audio signal to be outputted to a first device that a performer uses, the first audio signal on which the signal processing has been performed being a second audio signal, receiving a setting that causes the first audio signal to send to a monitor bus which is for to output the second audio signal, and performing signal processing on the second audio signal, which is received via the monitor bus and is to be outputted to a second device different from the first device, such that a sound quality of a sound to be outputted by the second device is closer to sound quality of a sound to be outputted by the first device than in a case where the signal processing is not performed on the second audio signal.

10 Claims, 8 Drawing Sheets

AUDIO SIGNAL PROCESSING METHOD AND AUDIO SIGNAL PROCESSING APPARATUS

CROSS REFERENCE TO RELATED APPLICATIONS

This Nonprovisional application claims priority under 35 U.S.C. § 119(a) on Patent Application No. 2019-160071 filed in Japan on Sep. 3, 2019 the entire contents of which are hereby incorporated by reference.

BACKGROUND OF THE INVENTION

1. Technical Field

A preferred embodiment of the present invention relates to an audio signal processing method and an audio signal processing apparatus.

2. Description of the Related Art

Japanese Unexamined Patent Application Publication No. 2015-080068 discloses a configuration in which a difference of the acoustic characteristics of two pairs of headphones of a different type is adjusted by an equalizer.

A performer who sings or plays music may listen to monitor sound, using in-ear headphones. An operating person (hereinafter referred to as an engineer) of a mixer also listens to monitor sound, using in-ear headphones or a speaker.

However, in a case in which the headphones that the performer uses, and the headphones that the engineer uses are not the same type of devices, the monitor sound to which the performer listens and the monitor sound to which the engineer listens have a different sound quality. Therefore, the engineer has prepared the headphones of the same type as the headphones that the performer uses, and has adjusted the sound quality of the monitor sound closer to the sound quality of the monitor sound to which the performer listens.

However, in a case in which a plurality of performers are present, the engineer, even when having adjusted the sound quality closer to the monitor sound to which one of the plurality of performers listens, eventually listens to sound of which the sound quality is different from the sound quality of the monitor sound to which a rest of the plurality of performers listens, when switching the monitor sound of the rest of the plurality of performers. Therefore, the engineer has needed to prepare headphones that each of the plurality of performers uses, and to change the headphones to use every time the monitor sound is switched.

SUMMARY OF THE INVENTION

In view of the foregoing, a preferred embodiment of the present invention is directed to provide an audio signal processing method and an audio signal processing apparatus that are able to listen to sound of which the sound quality is close to the sound quality of monitor sound to which each performer listens, without changing headphones even when switching the monitor sound.

An audio signal processing method performs signal processing on a first audio signal to be outputted to a first device that a performer uses, the first audio signal on which the signal processing has been performed being a second audio signal to send to a monitor bus which is for to output the second audio signal, and performing signal processing on the second audio signal, which is received via the monitor bus and is to be outputted to a second device different from the first device, such that a sound quality of a sound to be outputted by the second device is closer to sound quality of a sound to be outputted by the first device than in a case where the signal processing is not performed on the second audio signal.

According to a preferred embodiment of the present invention, sound of which the sound quality is close to the sound quality of monitor sound to which each performer listens is able to listen to without changing headphones even when switching the monitor sound.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
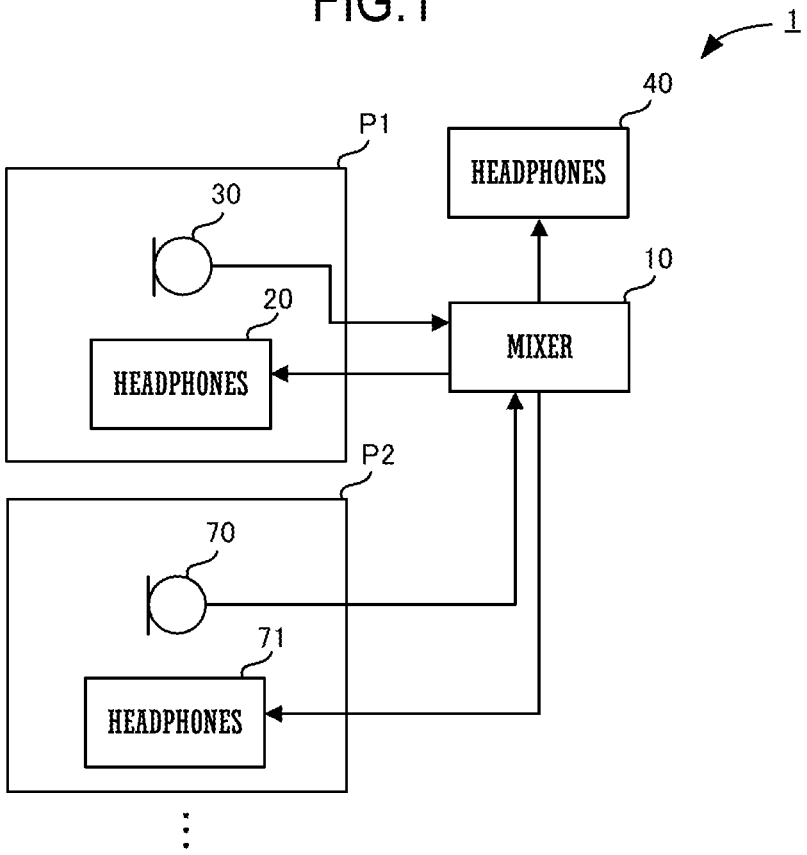
FIG. 1 is a block diagram showing a configuration of an audio signal processing system 1.

FIG. 1 is a block diagram showing a configuration of an audio signal processing system 1 according to a preferred embodiment of the present invention. The audio signal processing system 1 includes a mixer 10, headphones 20, headphones 71, a microphone 30, a microphone 70, and headphones 40. The headphones 20 are in-ear headphones that a certain performer P1 uses. The microphone 30 obtains the singing sound or performance sound of the performer P1. The headphones 71 are in-ear headphones that a performer P2 uses. The microphones 70 obtains the singing sound or performance sound of the performer P2. The headphones 20 and the headphone 71 are examples of a first device. The headphones 40 are in-ear headphones that an engineer uses, and are examples of a second device.

Figure 2:
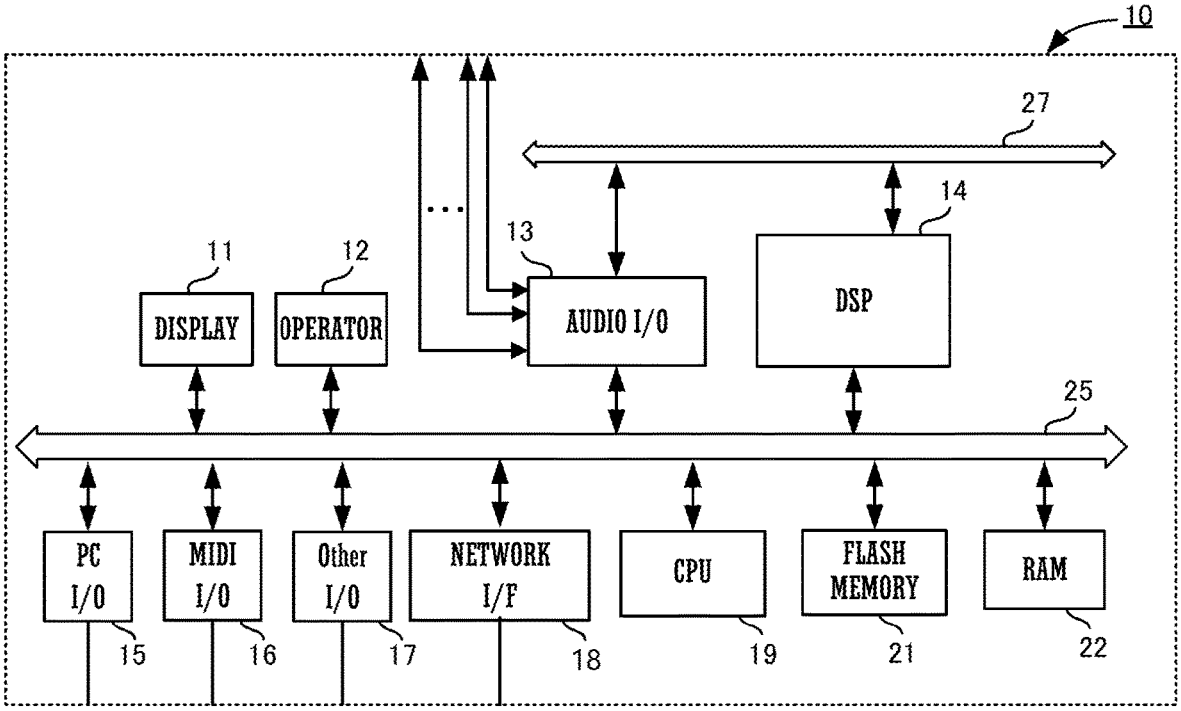
FIG. 2 is a block diagram showing a configuration of a mixer 10.

FIG. 2 is a block diagram showing a configuration of a mixer 10. The mixer 10 includes a display 11, an operator 12, an audio I/O (Input/Output) 13, a DSP (Digital Signal Processor) 14, a PC I/O 15, a MIDI I/O 16, a diverse (Other) I/O 17, a network I/F 18, a CPU 19, a flash memory 21, and a RAM 22.

The display 11, the operator 12, the audio I/O 13, the DSP 14, the PC I/O 15, the MIDI I/O 16, the Other I/O 17, the CPU 19, the flash memory 21, and the RAM 22 are connected to each other through a bus 25. In addition, the audio I/O 13 and the DSP 14 are also connected to a waveform bus 27 for transmitting an audio signal. It is to be noted that, as will be described below, an audio signal may be sent and received through the network I/F 18. In such a case, the DSP 14 and the network I/F 18 are connected through a not-shown dedicated bus.

The audio I/O 13 is an interface for receiving an input of an audio signal to be processed in the DSP 14. The audio I/O 13 includes an analog input port, a digital input port, or the like that receives the input of an audio signal. The audio I/O 13, for example, connects the microphone 30 and the microphone 70, and receives an input of an audio signal from the microphone 30 and the microphone 70.

In addition, the audio I/O 13 is an interface for outputting an audio signal that has been processed in the DSP 14. The audio I/O 13 includes an analog output port, a digital output port, or the like that outputs the audio signal. The audio I/O 13, for example, connects the headphones 20, the headphones 71, and the headphones 40, and outputs an audio signal to the headphones 20, the headphones 71, and the headphones 40.

Each of the PC I/O 15, the MIDI I/O 16, and the Other I/O 17 is an interface that is connected to various types of external devices and performs an input and output operation. The PC I/O 15 is connected to an information processor such as a personal computer, for example. The MIDI I/O 16 is connected to a MIDI compatible device such as a physical controller or an electronic musical instrument, for example. The Other I/O 17 is connected to a display, for example. Alternatively, the Other I/O 17 is connected to a UI (User Interface) device such as a mouse or a keyboard. Any standards such as Ethernet (registered trademark) or a USB (Universal Serial Bus) are able to be employed for communication with the external devices. The mode of connection may be wired or wireless.

The network I/F 18 communicates with a different apparatus through a network. In addition, the network I/F 18 receives an audio signal from the different apparatus through the network and inputs a received audio signal to the DSP 14. Further, the network I/F 18 receives the audio signal on which the signal processing has been performed in the DSP 14, and sends to the different apparatus through the network. The different apparatus includes the microphone 30, the microphone 70, the headphones 20, the headphones 71, and the headphones 40, each of which has a network I/F.

The CPU 19 is a controller that controls the operation of the mixer 10. The CPU 19 reads out a predetermined program stored in the flash memory 21 being a storage medium to the RAM 22 and performs various types of operations. It is to be noted that the program does not need to be stored in the flash memory 21 in the own apparatus. For example, the program may be downloaded each time from another apparatus such as a server and may be read out to the RAM 22.

The display 11 displays various types of information according to the control of the CPU 19. The display 11 includes an LCD or a light emitting diode (LED), for example.

The operator 12 receives an operation with respect to the mixer 10 from an engineer. The operator 12 includes various types of keys, buttons, rotary encoders, sliders, and the like. In addition, the operator 12 may include a touch panel laminated on the LCD being the display 11.

The DSP 14 performs various types of signal processing such as mixing or equalizing. The DSP 14 performs signal processing such as mixing or equalizing on an audio signal to be supplied from the audio I/O 13 through the waveform bus 27. The DSP 14 outputs a digital audio signal on which the signal processing has been performed, to the audio I/O 13 again through the waveform bus 27.

Figure 3:
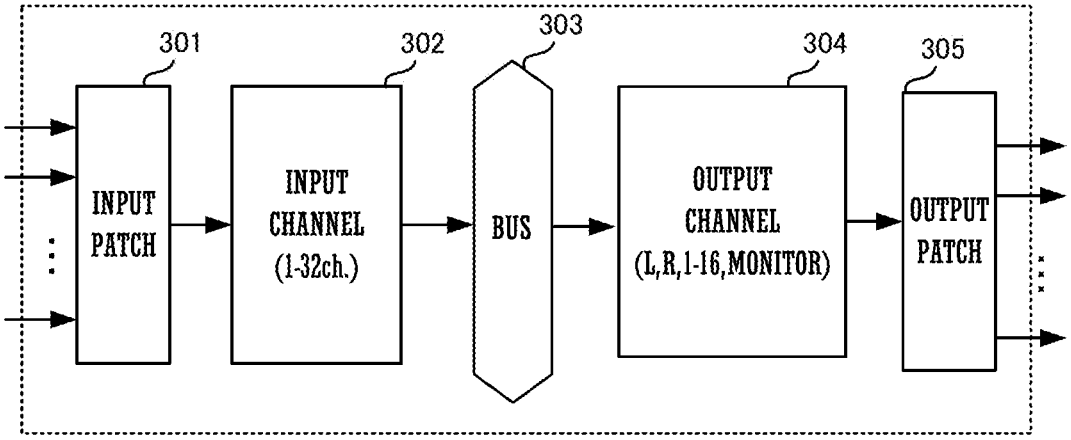
FIG. 3 is an equivalent block diagram of signal processing to be performed by a DSP 14, an audio I/O 13, and a CPU 19.

FIG. 3 is an equivalent block diagram showing a function of signal processing to be performed in the DSP 14, the audio I/O 13, and the CPU 19. As shown in FIG. 3, the signal processing is functionally performed through an input patch 301, an input channel 302, a bus 303, an output channel 304, and an output patch 305.

The input patch 301 receives an input of an audio signal from a plurality of input ports (an analog input port or a digital input port, for example) in the audio I/O 13 and assigns any one of a plurality of ports to at least one of a plurality of channels (32 channels, for example). As a result, the audio signal is supplied to each channel in the input channel 302.

Figure 4:
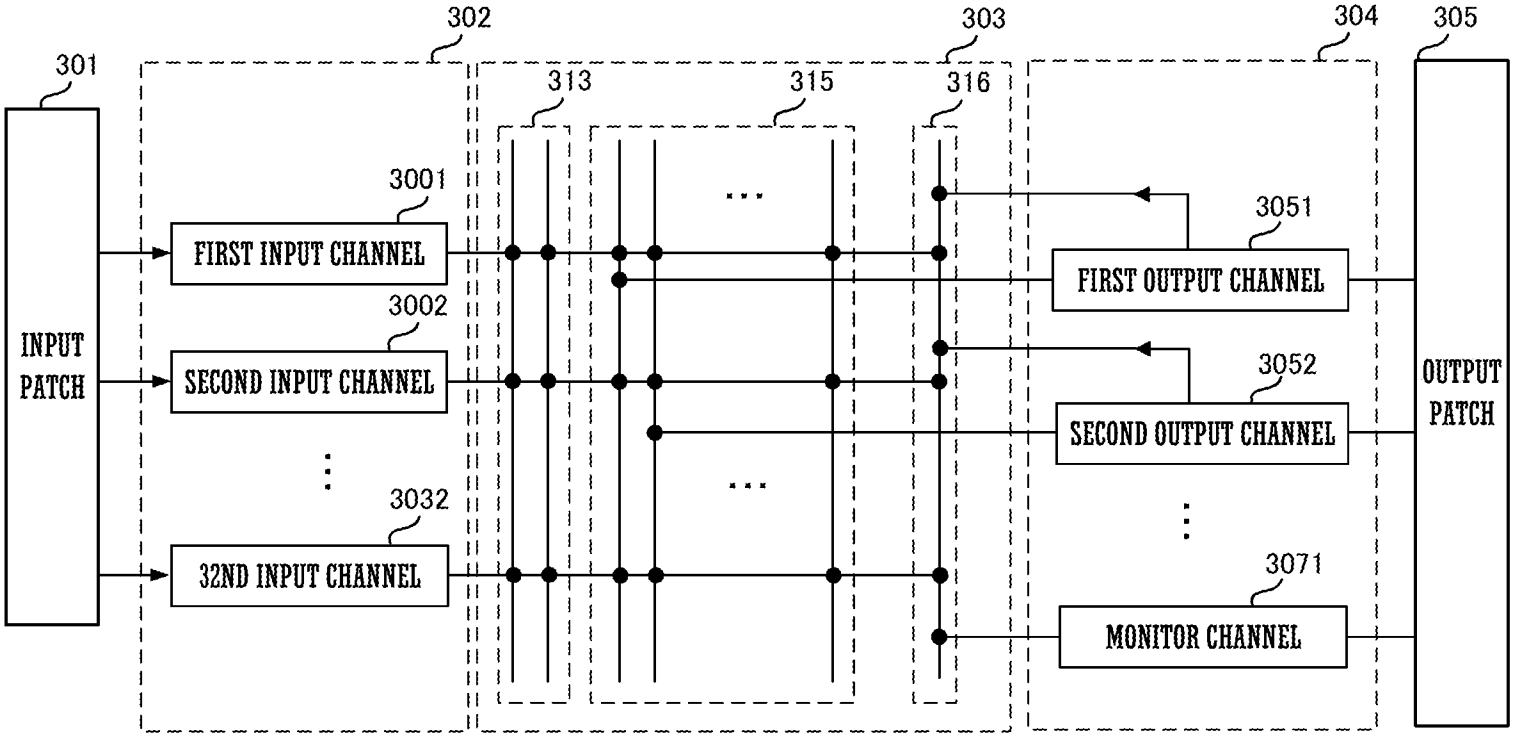
FIG. 4 is a diagram showing a functional configuration of an input channel 302, a bus 303, and an output channel 304.

FIG. 4 is a diagram showing a functional configuration of the input channel 302, the bus 303, and the output channel 304. The input channel 302 includes a plurality of signal processing blocks, for example, in order from a signal processing block 3001 of a first input channel, and a signal processing block 3002 of a second input channel, to a signal processing block 3032 of a 32nd input channel. Each signal processing block performs various types of signal processing such as an equalizing or compressing, to the audio signal supplied from the input patch 301.

The bus 303 includes a stereo bus 313, a MIX bus 315, and a monitor bus 316. A signal processing block of each of the input channels inputs the audio signal on which the signal processing has been performed, to the stereo bus 313, the MIX bus 315, and the monitor bus 316. Each signal processing block of the input channels sets an outgoing level with respect to each bus.

The stereo bus 313 corresponds to a stereo channel used as a main output in the output channel 304. The MIX bus 315 corresponds to a monitor speaker or monitor headphones (the headphones 20 and the headphones 71, for example) for each performer, for example. The monitor bus 316 corresponds to a monitor speaker or monitor headphones (the headphones 40, for example) for an engineer. Each of the stereo bus 313, the MIX bus 315, and the monitor bus 316 mixes inputted audio signals. Each of the stereo bus 313, the MIX bus 315, and the monitor bus 316 output the mixed audio signals to the output channel 304.

The output channel 304, as with the input channel 302, performs various types of signal processing on the audio signal inputted from the bus 303. For example, a signal processing block 3051 of a first output channel and a signal processing block 3052 of a second output channel perform signal processing on a first audio signal to be sent out from a first MIX bus and a second MIX bus. A signal processing block 3071 of a monitor channel performs signal processing on a second audio signal to be sent out from the monitor bus 316. The signal processing block 3051 and the signal processing block 3052 are examples of a first signal processor. The signal processing block 3071 is an example of a second signal processor.

The output channel 304 outputs the audio signal on which the signal processing has been performed in each signal processing block, to the output patch 305. The output patch 305 assigns each output channel to any one of a plurality of ports serving as an analog output port or a digital output port. As a result, the output patch 305 supplies the audio signal on which the signal processing has been performed, to the audio I/O 13.

Figure 5:
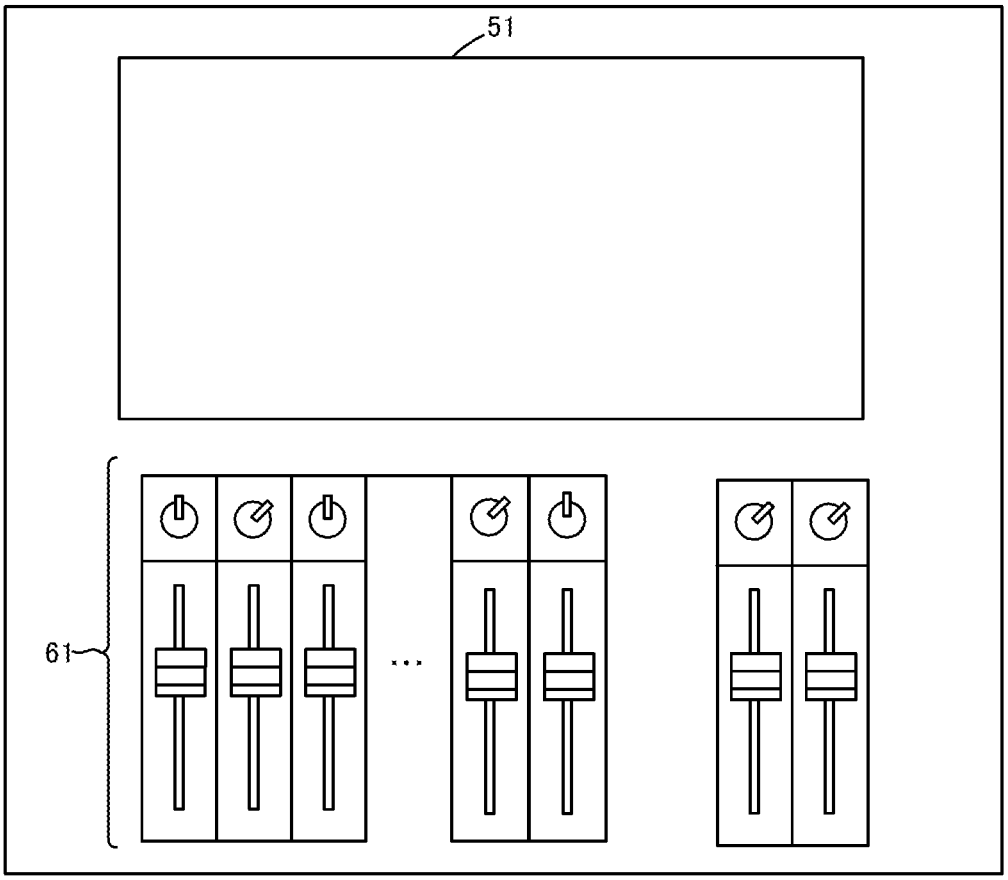
FIG. 5 is a diagram showing a configuration of an operation panel of the mixer 10.

An engineer sets a parameter of the above-described various types of signal processing, through the operator 12. FIG. 5 is a diagram showing a configuration of an operation panel of the mixer 10. As shown in FIG. 5, the mixer 10 includes on the operation panel a touch screen 51 and a channel strip 61. Such components correspond to the display 11 and the operator 12 shown in FIG. 2. It is to be noted that, although FIG. 5 only shows the touch screen 51 and the channel strip 61, a large number of knobs, switches, or the like may be provided in practice.

The touch screen 51 is the display 11 obtained by stacking the touch panel being one preferred embodiment of the operator 12, and constitutes a GUI (Graphical User Interface) for receiving an operation from a user.

The channel strip 61 is an area in which a plurality of physical controllers that receive an operation with respect to one channel are disposed vertically. Although FIG. 5 only shows one fader and one knob for each channel as the physical controllers, a large number of knobs, switches, or the like may be provided in practice. In the channel strip 61, a plurality of faders and knobs disposed on the left side correspond to the input channel. The two faders and two knobs disposed on the right side are physical controllers corresponding to the master output. An engineer operates a fader and a knob, sets a gain of each input channel or sets an outgoing level with respect to the bus 303. The CPU 19 controls signal processing to be performed by the input patch 301, the input channel 302, the bus 303, the output channel 304, and the output patch 305, based on the received setting of the gain and the received setting of the outgoing level.

An engineer selects an audio signal to be sent out to the monitor bus 316. For example, the engineer instructs to send out the first audio signal of the first MIX bus to the monitor bus 316.

Each signal processing block in the output channel 304 sends out the first audio signal on which signal processing has been performed, to the monitor bus 316. For example, when the engineer instructs to send out the first audio signal of the first MIX bus to the monitor bus 316, the signal processing block 3051 sends out the first audio signal on which the signal processing has been performed, to the monitor bus 316. The signal processing block 3071 of the monitor channel receives the first audio signal on which the signal processing has been performed in the signal processing block 3051, as a second audio signal. At such a time, the CPU 19 may control the audio signals to be sent out to the monitor bus 316 so as to reduce the level of the audio signals other than the first audio signal on which the signal processing has been performed in the signal processing block 3051. In such a case, the engineer can listen to only the monitor sound to which the performer P1 listens.

The signal processing block 3071 performs sound quality adjustment with respect to the second audio signal so that the sound quality of sound to be outputted from the headphones 40 is similar to the acoustic characteristics of the headphones 20. For example, the signal processing block 3071, with respect to the second audio signal, adjusts frequency characteristics so as to cancel the acoustic characteristics of the headphones 40 and so as to add the acoustic characteristics of the headphones 20. As a result, the engineer can listen to sound outputted from the first MIX bus with a sound quality reflecting the acoustic characteristics of the headphones 20 that the performer P1 uses.

Herein, for example, when the engineer instructs to send out the first audio signal of the second MIX bus to the monitor bus 316, the signal processing block 3052 sends out the first audio signal on which the signal processing has been performed, to the monitor bus 316. The signal processing block 3071 of the monitor channel receives the first audio signal on which the signal processing has been performed in the signal processing block 3052, as a second audio signal. The signal processing block 3071 performs sound quality adjustment with respect to the second audio signal so that the sound quality of sound to be outputted from the headphones 40 is similar to the acoustic characteristics of the headphones 71. For example, the signal processing block 3071, with respect to the second audio signal, adjusts frequency characteristics so as to cancel the acoustic characteristics of the headphones 40 and so as to add the acoustic characteristics of the headphones 71. As a result, the engineer can listen to sound outputted from the second MIX bus with a sound quality reflecting the acoustic characteristics of the headphones 71 that the performer P2 uses.

In such a manner, according to the mixer 10 of the present preferred embodiment, an engineer can listen to monitor sound with a sound quality close to the acoustic characteristics of the headphones that each performer uses, without having to perform a complicated operation, only by performing an operation to switch a channel to be monitored.

The mixer 10 performs the following operations, for example, in order to perform sound quality adjustment so as to be closer to the acoustic characteristics of target headphones (the first device).

Figure 6:
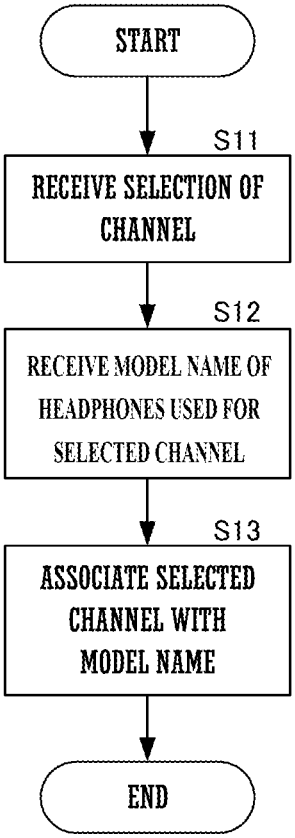
FIG. 6 is a flow chart showing an operation of the mixer 10.
Figure 7:
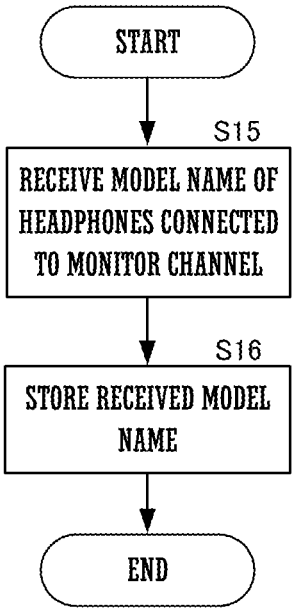
FIG. 7 is a flow chart showing an operation of the mixer 10.
Figure 8:
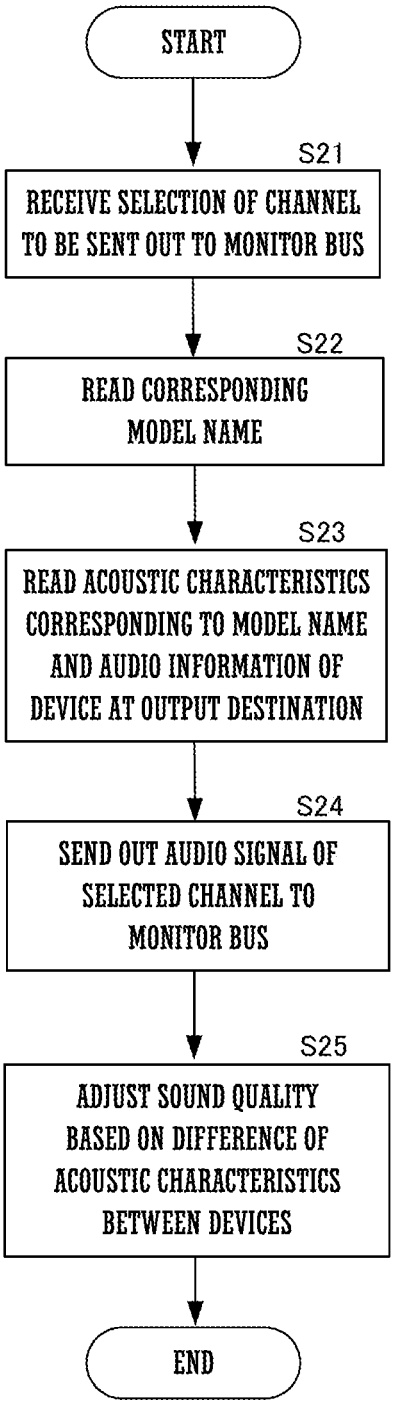
FIG. 8 is a flow chart showing an operation of the mixer 10.

FIG. 6, FIG. 7, and FIG. 8 are flow charts showing an operation of the mixer 10. The operation shown in FIG. 6 and FIG. 7 is performed when an engineer operates the mixer 10 before a rehearsal. The operation shown in FIG. 8 is performed when an engineer operates mixer 10 during a rehearsal or during an actual performance.

As shown in FIG. 6, first, the CPU 19 receives a selection of a channel through an operator 12 (S11). Subsequently, the CPU 19 receives a model name of the headphones used by a performer of the selected channel (S12). The model name is an example of information associated with a second device. The CPU 19 associates the selected channel with the information on the model name (S13), and stores the associated channel and information in the flash memory 21 or the RAM 22.

In addition, as shown in FIG. 7, the CPU 19 receives the model name of the headphones connected to a monitor channel through the operator 12 (S15). In other words, the CPU 19 receives the model name of the headphones that the engineer uses. The model name is an example of information associated with the first device. The CPU 19 stores information on the received model name in the flash memory 21 or the RAM 22 (S16).

As shown in FIG. 8, the CPU 19 receives from an engineer a selection of a channel to be sent out to the monitor bus 316 (S21). Subsequently, the CPU 19 refers to the information stored in the flash memory 21 or the RAM 22 and reads out the model name of the headphones associated with the selected channel (S22).

The CPU 19 reads out the acoustic characteristics corresponding to the read model name, and the acoustic characteristics of the second device (the headphones 40) at an output destination (S23). The information on the acoustic characteristics with respect to a model name is stored in the flash memory 21 or the RAM 22, for example. The CPU 19 reads out corresponding acoustic characteristics from the flash memory 21 or the RAM 22. Alternatively, the CPU 19 may obtain acoustic information corresponding to a model name from another apparatus such as a server. The acoustic characteristics of the headphones 40 are also stored in the flash memory 21 or the RAM 22, for example. The CPU 19 reads out the acoustic characteristics corresponding to the model name of the headphones 40 stored in S16, from the flash memory 21 or the RAM 22. Alternatively, the CPU 19 may obtain the acoustic characteristics of the headphones 40 from another apparatus such as a server.

The CPU 19 performs a setting to send out a first audio signal of the selected channel to the monitor bus 316 (S24). As a result, the signal processing block 3071 receives the first audio signal of the selected channel as a second audio signal. The CPU 19 sets the signal processing block 3071 being a second signal processor so as to perform the sound quality adjustment of the second audio signal based on a difference of the acoustic characteristics between devices (S25). The signal processing block 3071, for example, as described above, adjusts frequency characteristics so as to cancel the acoustic characteristics of the headphones 40 and so as to add the acoustic characteristics of the first device (the headphones 20 or the headphones 71, for example). Alternatively, the signal processing block 3071 may perform the sound quality adjustment based on the difference of the acoustic characteristics between the first device and the second device.

It is to be noted that the acoustic characteristics are also able to be measured using a microphone. For example, an engineer prepares a small microphone such as a capacitor microphone, and a dummy head. The engineer attaches the microphone and the target headphones to the ears of the dummy head. The engineer operates the mixer 10, outputs a test sound such as white noise from the headphones, and measures the acoustic characteristics of an audio signal obtained by the microphone. As a result, the mixer 10 measures the acoustic characteristics. In such a case, the mixer 10 does not need to perform the processing of S12 of FIG. 6. In addition, the mixer 10, in the processing of S13, associates the selected channel with the measured acoustic characteristics, and stores the associated channel and acoustic characteristics in the flash memory 21 or the RAM 22. In addition, the mixer 10, in the processing of S16 in FIG. 7, stores the measured acoustic characteristics. The mixer 10 does not need to perform the processing of S22 of FIG. 8. The mixer 10, in the processing of S23, reads out the acoustic characteristics corresponding to the selected channel.

It is to be noted that the mixer 10, in the processing of S11, may receive an input of information (a name of a performer, for example) associated with a performer. In such a case, the mixer 10, in the processing of S12, receives the model name of the headphones that a received performer uses. Then, the CPU 19, in the processing of S13, associates the information associated with the performer with the model name of the headphones, and stores the associated information and model name in the flash memory 21 or the RAM 22.

In addition, the mixer 10, in the processing of S21 of FIG. 8, receives an input of the information associated with the performer. In such a case, the mixer 10, in the processing of S22, reads out a model name corresponding to the information associated with the received performer. Therefore, the mixer 10, in S23, reads out acoustic characteristics corresponding to the information associated with the received performer.

In such a manner, the mixer 10 is able to obtain information associated with a performer and information associated with a second device, and also perform the sound quality adjustment based on the information associated with a performer and the information associated with a second device.

The description of the foregoing preferred embodiments is illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

For example, the preferred embodiment provides an example in which both a performer and an engineer use in-ear headphones. However, for example, a performer or an engineer may use a speaker. In such a case as well, the mixer 10 performs the sound quality adjustment of a second audio signal to be outputted to the monitor headphones or a speaker for an engineer, according to the acoustic characteristics of headphones or a speaker to be monitored.

In addition, the preferred embodiment provides an example in which the sound quality adjustment of a second audio signal is performed according to the acoustic characteristics of headphones or a speaker to be monitored. However, the mixer 10, as long as performing the sound quality adjustment so that the sound quality of sound to be outputted from the second device is closer to the sound quality of sound to be outputted from the first device, may perform any type of processing. For example, in a case in which the headphones 20 of the performer P1 performs effect processing such as compressing on an inputted first signal, the mixer 10 may perform the same effect processing on a second audio signal.

In addition, the preferred embodiment provides an example in which an engineer inputs information according to a device, such as a model name. However, an engineer does not need to manually input such information including a model name. For example, the mixer 10, in a case of being connected to headphones through a network, obtains information (including a manufacturing number) unique to a device. The mixer 10 obtains a model name corresponding to a manufacturing number from a management server or the like that manages the manufacturing number and the model name.

What is claimed is:

1. An audio signal processing method comprising:

performing first signal processing in an output channel on a first audio signal to be outputted from a mix bus to a first device that a performer uses;

performing second signal processing in a monitor channel on a second audio signal to be outputted from a monitor bus to a second device different from the first device;

receiving a first selection of the output channel and first model information of the first device;

associating the selected output channel with the first model information of the first device;

receiving second model information of the second device;

receiving first acoustic characteristics corresponding to the first model information associated with the selected output channel and second acoustic characteristics corresponding to the second model information, when a second selection of the output channel, which causes the first audio signal to be sent to the monitor bus, is received; and performing a sound quality adjustment as the second signal processing in the monitor channel based on the first acoustic characteristics and the second acoustic characteristics, wherein when the second selection of the output channel that causes the first audio signal to be sent to the monitor bus is received, (i) the first audio signal on which the first signal processing has been performed is sent to the monitor bus as the second audio signal, and (ii) the performing the second signal processing on the second audio signal comprises performing the sound quality adjustment on the second audio signal such that a sound quality of a sound to be outputted, based on the second signal processing performed on the first audio signal on which the first signal processing has been performed, by the second device is closer to a sound quality of a sound to be outputted, based on the first signal processing performed on the first audio signal outputted from the mix bus, by the first device than in a case where the sound quality adjustment is not performed on the second audio signal.

2. The audio signal processing method according to claim 1, wherein the first model information of the first device is received through an operator.

3. The audio signal processing method according to claim 1, wherein the sound quality adjustment is performed on the second audio signal based on a difference between the first acoustic characteristics of the first device and the second acoustic characteristics of the second device.

4. The audio signal processing method according to claim 1, wherein the sound quality adjustment performed on the second audio signal includes adding the first acoustic characteristics of the first device after cancelling the second acoustic characteristics of the second device.

5. The audio signal processing method according to claim 1, wherein the first acoustic characteristics or the second acoustic characteristics are obtained by a microphone.

6. An audio signal processing apparatus comprising:

a mix bus;

a monitor bus;

an output channel configured to perform first signal processing on a first audio signal to be outputted from the mix bus to a first device that a performer uses;

a monitor channel configured to perform second signal processing on a second audio signal to be outputted from the monitor bus to a second device different from the first device; and a controller configured to:

receive a first selection of the output channel and first model information of the first device;

associate the selected output channel with the first model information of the first device;

receive second model information of the second device;

receive first acoustic characteristics corresponding to the first model information associated with the selected output channel and second acoustic characteristics corresponding to the second model information, when a second selection of the output channel, which causes the first audio signal to be sent to the monitor bus, is received; and cause the monitor channel to perform a sound quality adjustment as the second signal processing based on the first acoustic characteristics and the second acoustic characteristics;

wherein the controller, when the second selection of the output channel that causes the first audio signal to be sent to the monitor bus is received, causes (i) the first audio signal on which the first signal processing has been performed to be sent to the monitor bus as the second audio signal and (ii) the monitor channel to perform the second signal processing on the second audio signal by performing the sound quality adjustment on the second audio signal such that a sound quality of a sound to be outputted, based on the second signal processing performed on the first audio signal on which the first signal processing has been performed, by the second device is closer to a sound quality of a sound to be outputted, based on the first signal processing performed on the first audio signal outputted from the mix bus, by the first device than in a case where the sound quality adjustment is not performed on the second audio signal.

7. The audio signal processing apparatus according to claim 6, wherein the controller is configured to receive the first model information of the first device through an operator.

8. The audio signal processing apparatus according to claim 6, wherein the monitor channel is configured to perform the sound quality adjustment on the second audio signal based on a difference between the first acoustic characteristics of the first device and the second acoustic characteristics of the second device.

9. The audio signal processing apparatus according to claim 6, wherein the monitor channel is configured to perform the sound quality adjustment on the second audio signal by adding the first acoustic characteristics of the first device after cancelling the second acoustic characteristics of the second device.

10. The audio signal processing apparatus according to claim 6, further comprising a microphone configured to obtain the first acoustic characteristics or the second acoustic characteristics.

* * * * *